US007737846B2

(12) United States Patent
Belden, Jr. et al.

(10) Patent No.: US 7,737,846 B2
(45) **Date of Patent: *Jun. 15, 2010**

(54) SECURITY SYSTEM AND METHOD FOR PROTECTING MERCHANDISE

(75) Inventors: Dennis D. Belden, Jr., Canton, OH (US); Christopher J. Fawcett, Charlotte, NC (US); Ronald M. Marsilio, Lake Wiley, SC (US); Ian R. Scott, Duluth, GA (US)

(73) Assignee: Invue Security Products Inc., Charlotte, NC (US)

( * ) Notice: Subject to any disclaimer, the term of this patent is extended or adjusted under 35 U.S.C. 154(b) by 506 days.

This patent is subject to a terminal disclaimer.

(21) Appl. No.: 11/639,102

(22) Filed: Dec. 14, 2006

(65) Prior Publication Data

US 2007/0159328 A1 Jul. 12, 2007

Related U.S. Application Data

(60) Provisional application No. 60/753,908, filed on Dec. 23, 2005.

(51) Int. Cl.
*G08B 13/12* (2006.01)

(52) U.S. Cl. ..... 340/568.2; 340/5.25; 340/693.5; 340/815.45

(58) Field of Classification Search ..... 340/568.2, 340/568.1, 568.8, 572.1, 693.5, 691.1, 815.45, 340/5.25, 5.21–5.23, 5.28, 5.6, 5.61, 5.64, 340/5.65, 309.16, 10.51, 571, 543
See application file for complete search history.

(56) References Cited

U.S. PATENT DOCUMENTS 3,493,955 A 2/1970 Minasy
3,685,037 A * 8/1972 Bennett et al. ..... 340/571
4,573,042 A 2/1986 Boyd et al.
4,686,513 A 8/1987 Farrar et al.
4,800,369 A 1/1989 Gomi et al.
4,851,815 A 7/1989 Enkelmann (Continued)

FOREIGN PATENT DOCUMENTS

JP 8279082 10/1996

*Primary Examiner*—Thomas J Mullen
(74) *Attorney, Agent, or Firm*—Christopher C. Dremann, P.C.

(57) ABSTRACT

A security system for protecting items of merchandise includes a programmable key, a programming station for generating a security disarm code (SDC) into the key, and a security device attached to the item of merchandise. The security device is initially programmed with the SDC from the key and is subsequently disarmed by the key upon matching the SDC of the key with the SDC stored in the security device. A wireless interface is provided in the programming station, programmable key and security device for programming the SDC into the key and for matching the SDC of the key with the SDC of the alarm module. An internal timer in the key invalidates the SDC in the key after a predetermined time period to prevent use of the key for disarming a security device after the time period has expired. The programming station initially generates a unique SDC which remains in the programming station for use with the programmable keys and alarm modules. Each retail store will have its own programming station so that each store has its own unique SDC usable only in that store and with the keys programmed therein.

18 Claims, 12 Drawing Sheets

U.S. PATENT DOCUMENTS 4,853,692 A 8/1989 Wolk et al.
4,926,665 A * 5/1990 Stapley et al. ..... 70/277
4,980,671 A 12/1990 McCurdy
5,005,125 A 4/1991 Farrar et al.
5,170,431 A * 12/1992 Dawson et al. ..... 340/5.28
5,182,543 A 1/1993 Siegel et al.
5,245,317 A 9/1993 Chidley et al.
5,367,289 A 11/1994 Baro et al.
5,570,080 A 10/1996 Inoue et al.
5,589,819 A 12/1996 Takeda
5,610,587 A 3/1997 Fujiuchi et al.
5,640,144 A 6/1997 Russo et al.
5,656,998 A 8/1997 Fujiuchi et al.
5,701,828 A * 12/1997 Benore et al. ..... 340/5.65
5,764,147 A 6/1998 Sasagawa et al.
5,767,773 A 6/1998 Fujiuchi et al.
5,793,290 A 8/1998 Eagleson et al.
5,808,548 A 9/1998 Sasagawa et al.
5,836,002 A * 11/1998 Morstein et al. ..... 340/568.1
5,838,234 A 11/1998 Roulleaux-Robin
5,864,290 A 1/1999 Toyomi et al.
5,955,951 A 9/1999 Wischerop et al.
5,982,283 A 11/1999 Matsudaira et al.
6,020,819 A 2/2000 Fujiuchi et al.
6,037,879 A 3/2000 Tuttle
6,043,744 A 3/2000 Matsudaira
6,104,285 A 8/2000 Stobbe
6,118,367 A 9/2000 Ishii
6,122,704 A * 9/2000 Hass et al. ..... 711/100
6,137,414 A 10/2000 Federman
6,144,299 A 11/2000 Cole
6,255,951 B1 7/2001 De La Huerga
6,300,873 B1 * 10/2001 Kucharczyk et al. ..... 340/568.1
6,304,181 B1 10/2001 Matsudaira
6,346,886 B1 2/2002 De La Huerga
6,384,711 B1 * 5/2002 Cregger et al. ..... 340/5.65
6,420,971 B1 7/2002 Leck et al.
6,433,689 B1 8/2002 Hovind et al.
6,474,117 B2 11/2002 Okuno
6,512,457 B2 1/2003 Irizarry et al.
6,531,961 B2 3/2003 Matsudaira
6,535,130 B2 3/2003 Nguyen et al.
6,961,000 B2 11/2005 Chung
7,102,509 B1 9/2006 Anders et al.
7,482,907 B2 * 1/2009 Denison et al. ..... 340/5.2
2002/0024440 A1 2/2002 Okuno
2003/0206106 A1 * 11/2003 Deconinck et al. ..... 340/568.2
2005/0073413 A1 * 4/2005 Sedon et al. ..... 340/568.8

* cited by examiner

SECURITY SYSTEM AND METHOD FOR PROTECTING MERCHANDISE

CROSS REFERENCE TO RELATED APPLICATIONS

This application claims priority from U.S. Provisional Application Ser. No. 60/753,908 filed Dec. 23, 2005; the disclosure of which is incorporated herein by reference.

BACKGROUND OF THE INVENTION

1. Technical Field

The invention relates to security devices, systems and methods for protection of merchandise, and in particular to a system based on a smart key that is programmed with a security disarm code (SDC) at a programming station, which key is used to program the SDC code into various alarm modules attached to items of merchandise.

2. Background Information

Various retail establishments use numerous types of theft deterrent devices and systems to discourage shoplifters. Many of these systems use alarm modules and security devices which are attached to the article to be protected in one manner or another. When the integrity of the module or the item of merchandise protected thereby is compromised in any manner, such as cutting cables which attach the security device to the item of merchandise, removing the merchandise from the security device or disturbing the security device, will cause an audible alarm to be sounded in the security device to alert store personnel that the item of merchandise or security device is being tampered with illegally. These security devices, as well as the items of merchandise protected thereby, also may contain various electronic article surveillance tags (EAS) which will sound an alarm at a security gate upon passing through the gate in an unauthorized manner.

These alarm modules or security devices which are attached to the items of merchandise usually have some type of key, either mechanical or magnetic, which is used to unlock the device from the protected item of merchandise to enable the merchandise to be taken to a checkout counter, as well as to disarm the alarm contained in the alarm module. One problem with such security systems is that these keys will be stolen from the retail establishment and used at the same establishment or at another store using the same type of alarm module or security device, to enable a thief to disarm the alarm module as well as unlock it from the protected merchandise. These keys also are stolen by dishonest employees for subsequent unauthorized use by the employee or sale to a thief for use at the same or other stores which use the same type of alarm modules and security devices controlled by the key.

It is extremely difficult to prevent the theft of these keys by dishonest employees or even by a thief within the retail establishment due to the number of keys that must be available and used by the clerks in the various departments of the store to facilitate the use of the numerous alarm modules and security devices that are needed to protect the numerous items of merchandise.

Thus, the need exists for a security system which uses various types of alarm modules and security devices which are attached to various items of merchandise, which will prevent a thief or dishonest employee from using the key that is needed to disarm and unlock the security device in an unauthorized manner on similar types of alarm modules at various retail establishments including the store from which the key was stolen.

BRIEF SUMMARY OF THE INVENTION

One aspect of the present invention is to provide a security system and method for protecting items of merchandise which use a smart key for disarming the security device which is attached to the merchandise, which key is programmable with a unique security disarm code (SDC), which code is provided to the key by a programming station, wherein the SDC is unique to a particular retail establishment, thereby preventing the key from being used at a different store than that from which the key is stolen.

A further aspect of the present invention is to use the SDC which is programmed into the smart key by a programming station, to program each of the individual alarm modules or security devices used in that store with the same SDC when the alarm modules and devices are first activated, which SDC remains with the alarm module throughout its use in the particular retail establishment.

Another aspect of the present invention is to provide such a security system in which the smart key is provided with an internal timer which after a preset period of time, for example 96 hours, will automatically invalidate or erase the SDC in the key thereby preventing its unauthorized use even in the particular retail establishment in which the programming station is located and the SDC was initially programmed into the key, after the preset time period.

A further feature of the present invention is to require the smart key to be reprogrammed with the SDC by the programming station within a preset time period, which reprogramming can be performed by authorized personnel insuring that the key can only be used by authorized clerks, and only in the store having the programmable station and the single unique SDC for all of the security devices in the store.

Another feature of the present invention is to provide the smart key with an internal counter which counts the number of activations performed by the key, that is, the initial activation of every alarm module as well as each time the key is used to disarm one or more of the alarm modules, and upon a predetermined number of activations occurring will permanently inactivate the key thereby ensuring that an active key always has sufficient internal power to receive the SDC and subsequently communicate with the alarm modules for disarming the modules when required. Furthermore, the internal counter will actuate an indicating signal a predetermined time period before permanently deactivating the control circuit of the key after the maximum number of activations have been provided by the key.

Still another aspect of the present invention is to provide wireless communication between the various elements of the system, namely the smart key, programming station and alarm module based upon infrared (IR), radio frequency (RF) or similar wireless transmission systems.

A still further aspect of invention is to enable the alarm module or security device to actuate an alarm if a key is attempted to be used to disarm the alarm module containing a wrong SDC.

Still another feature of the invention is to retain the SDC in the programming station within a non-volatile memory enabling it to survive a power interruption.

A further aspect of the present invention is to enable the programming station upon reading a SDC stored in a key which does not match the SDC of the programming station to immediately time out the wrong SDC programmed into the key preventing subsequent use of the key.

Another feature of the invention is to provide the programming station with a plurality of visual indicators which are illuminated and/or pulsed to indicate the status of the programming station.

Still another aspect of invention is the incorporation of an operational lifetime timer into the logic control circuit of the alarm module which is preset for a specific period of time to ensure that the self-contained battery has sufficient charge for operating the alarm module; and that the alarm module includes a counter which records the amount of time that the audible alarm is activated, which alarm activation time automatically reduces the lifetime period in the lifetime timer by a predetermined amount. The lifetime counter automatically disables the alarm module at the end of the adjusted lifetime.

A further aspect of the invention is that the lifetime counter in the alarm module will activate an end-of-life signal a predetermined time period before the lifetime timer completely disables the alarm module enabling store personnel to replace the same with a new and sufficiently charged alarm module.

Another feature of the invention is to mount a piezo electric audible alarm in the alarm module in direct communication with an open sound space formed between the bottom of the alarm module and mounting base to increase the dB level of the alarm sound than that obtainable if the alarm was mounted entirely internally within the alarm housing.

A further feature of the invention is to provide the alarm module with a plurality of connection ports for attachment of one or more attachment cables extending between the alarm module and items of merchandise, which cables will contain a sense loop which will sound an alarm within the module if the integrity of the sense loop is compromised by a thief.

Another aspect of the present invention is to enable the logic control circuit of the programming station to permanently inactivate the SDC in a smart key if the SDC contained therein does not match that of the programming station when in communication with the logic control circuit of the programming station.

Still another aspect of the invention is to provide the programming station with a plurality of LEDs which provide various status displays depending upon the condition and state of operation of the programming station.

Another feature of the invention is to provide the programming station with a mechanically actuated tumbler switch requiring a key to operate, which key can be controlled by the store manager or other authorized personnel in order to activate the programming station for the initial and subsequent programming of the SDC into the smart keys.

Still another feature of the invention is to provide the programming station with mechanical attachment means for securing it to a supporting structure in a secure location wherein the programming station is connected to an external power source ensuring that the required power is always available at the programming station avoiding the use of an internal battery power supply source.

A further aspect of the invention is to provide the key and programming station with a light pipe which will facilitate the transfer of the IR wireless communication wavelengths between the key and alarm module.

Another aspect of the invention is to form a portion of the housing of the programming station of an infrared clear plastic material to facilitate the transmission of IR waves between the wireless communication systems of the key and programming station.

Still another feature of the invention is to form the sense loops extending between the alarm modules and attached items of merchandise of an electrical conductor or fiber optic conductor located within an outer mechanical attachment cable.

These features are obtained by the security system of the present invention the general nature of which may be stated as including a programmable key, a programming station for generating a security disarm code (SDC) in the key, a security device for attachment to the item of merchandise, said security device receiving the SDC from the key when initially activated and for subsequent use to disarm the security device.

These aspects and features are further obtained by the method of the present invention used for protecting an object, the general nature of which may be stated as including the steps of attaching an alarm module to the object, programming a key with a security disarm code (SDC), programming the SDC into the alarm module from the key, disarming the alarm module by verifying the SDC in the key with the SDC in the alarm module by wireless communication between the key and alarm module, and invalidating the SDC in the key after a period of time to prevent subsequent disarming of the alarm module by said key unless the SDC is refreshed in the key within said period of time.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
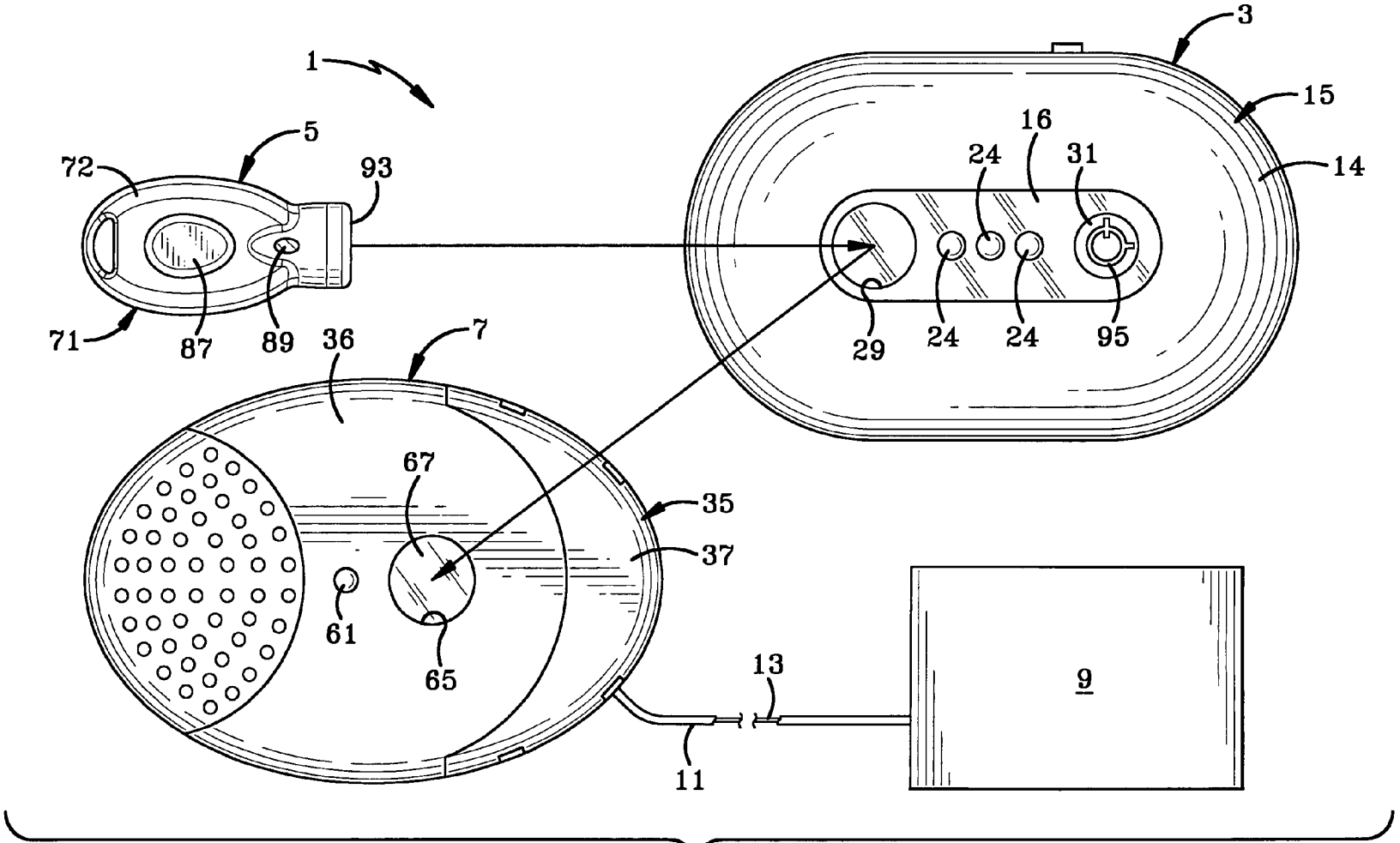
FIG. 1 is a diagrammatic view of the principal components of the security system of the present invention.

The preferred embodiment of the improved security system of the present invention is indicated generally at 1, and is shown in FIG. 1. Security system 1 includes three main components, a programming station 3, a programmable smart key 5 and an alarm module or security device 7 which is adapted to be attached to an article of merchandise 9 by an attachment device such as a cable 11, which preferably contains a sense loop 13.

Figure 2:
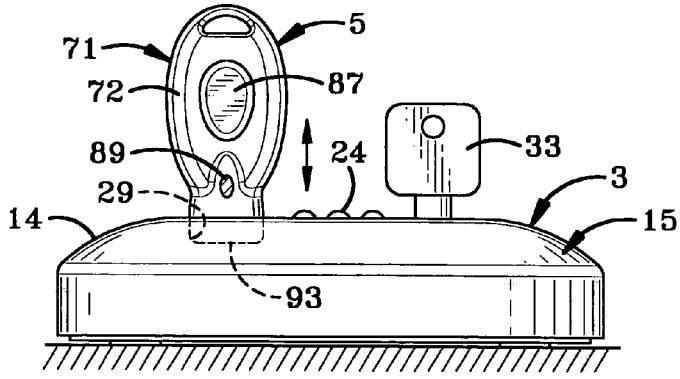
FIG. 2 is a diagrammatic side elevational view of the programming station component of the security system.
Figure 3:
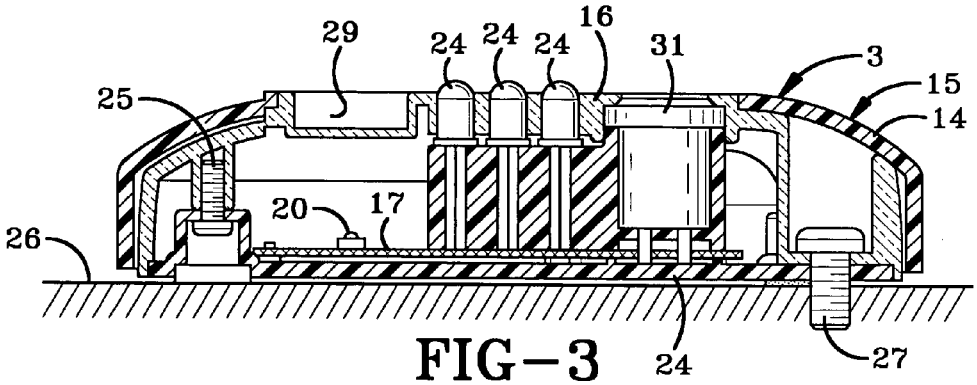
FIG. 3 is a cross-sectional view of the programming station of FIG. 2.
Figure 4:
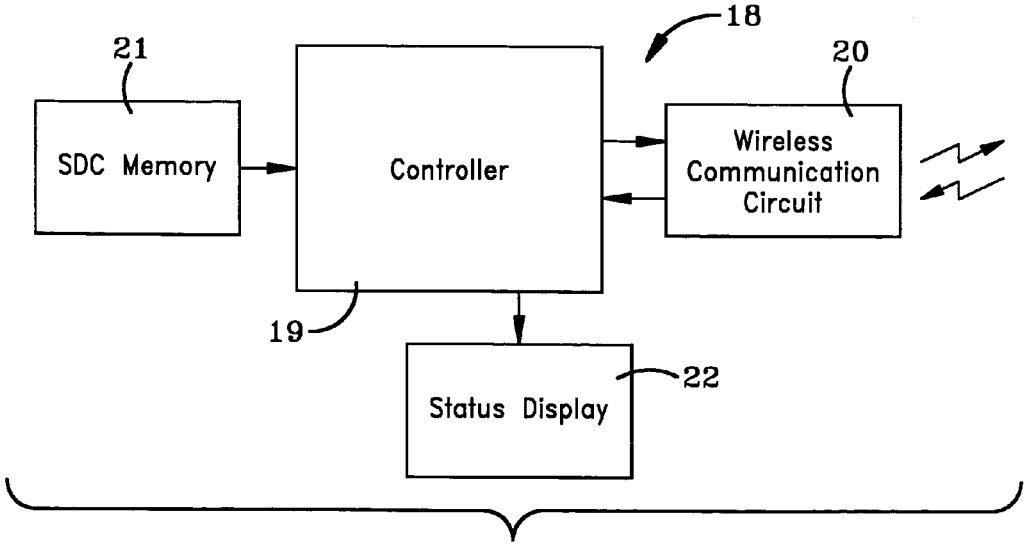
FIG. 4 is a block diagram of the logic control circuit of the programming station shown in FIG. 2.

Programming station 3 preferably is of the type shown and described in detail in a pending patent application entitled, *Programming Station For A Security System For Protecting Merchandise* filed concurrently herewith, the contents of which are incorporated herein by reference. Programming station 3 is shown in FIGS. 2-4 and includes a housing 15 formed by an internal housing shell 16 preferably formed of an infrared clear plastic material to facilitate the transfer of infrared wireless communication waves, as discussed further below. Housing 15 furthermore includes a top cover plate 14 snap-fitted onto shell 16 and a printed circuit board 17 containing a control logic circuit 18 located therein. Logic control circuit 18 is shown in block diagram form in FIG. 4.

Logic control circuit 18 includes a main controller 19 which preferably is a microprocessor, a wireless communication circuit 20 and a security disarm code (SDC) memory 21 communicating with controller 19. A status display 22 which consists of three LEDs 24 also is part of control circuit 18 and provides a visual indication of the status of programming station 3 during and after the use of programming station 3 for programming the SDC into smart key 5. Housing shell 16 is secured to a base 24 by fasteners 25, which base can be secured to a supporting structure 26 by fasteners 27. Wireless communication circuit 20, and in particular the transmission and receive components thereof, are aligned with a key receiving port 29 found in housing shell 16, which port is adapted to receive smart key 5 therein as shown in FIG. 2. Wireless communication circuit 20 and the various components thereof which are formed on circuit board 17, in the preferred embodiment will be an infrared (IR) system, although radio frequency (RF) or other types of wireless communications could be used without affecting the concept of the invention.

A key-actuated tumbler switch 31 is mounted in housing 15 and is controlled by a mechanical key 33 for activating the logic control circuit within programming station 3 for programming a smart key 5 with the SDC as discussed further below. The particular circuitry of logic control circuit 18 is shown in further detail in the above-referenced pending patent application, but could be other types of circuitry than that shown therein, which circuits are readily known to those skilled in the art for obtaining the features and results of the programming station as discussed further below.

Programming station 3 preferably is powered by an external power supply such as a usual 120 volt electrical outlet readily found in a retail establishment. Preferably, station 3 will be secured to support surface 26 in a secure location, such as the store manager's office or similar protected environment. Likewise, activation key 33 will be kept in the possession of the store manager or other highly trusted employee to prevent the unauthorized use of programming station 3.

Figure 5:
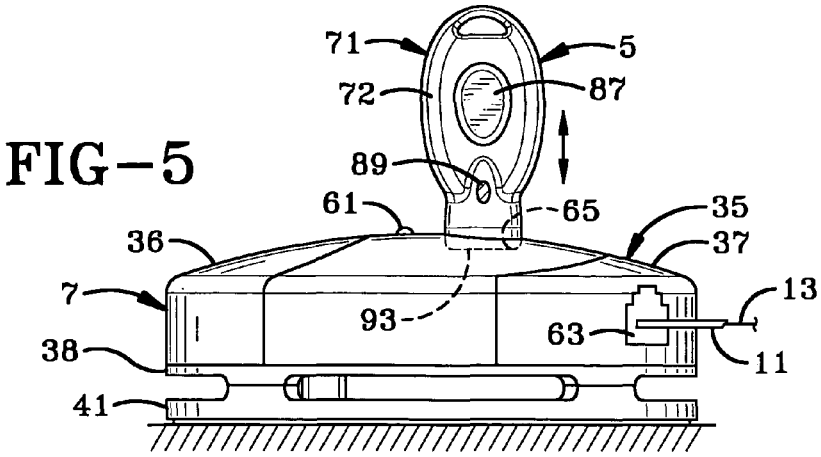
FIG. 5 is a diagrammatic side elevational view of one type of security device which can be used in the security system of the present invention.
Figure 6:
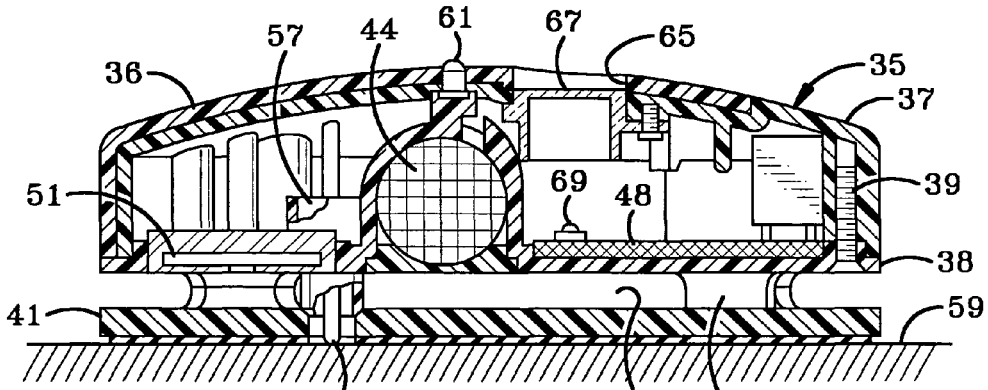
FIG. 6 is a cross-sectional view of the security device of FIG. 5.
Figure 7:
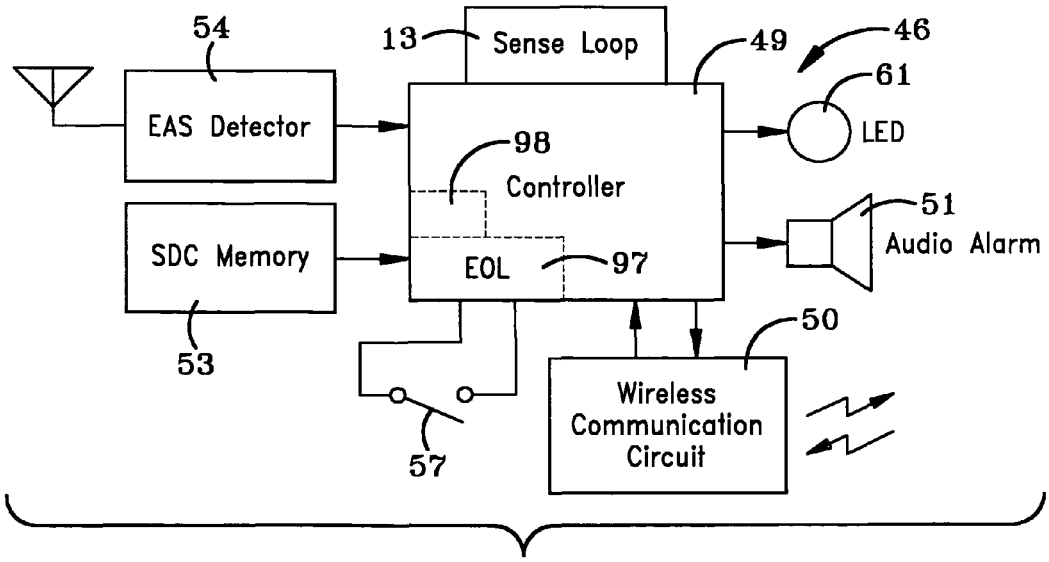
FIG. 7 is a block diagram of the logic control circuit of the security device shown in FIG. 5.

Alarm module 7, shown particularly in FIGS. 5, 6 and 7 is one type of security device which can be used with the security system of the present invention. Alarm module 7 is of the type shown and described in greater detail in a pending patent application filed concurrently herewith entitled, *Programmable Alarm Module And System For Protecting Merchandise*, the contents of which are incorporated herein by reference. Alarm module 7 includes a housing 35 preferably formed of plastic material which includes a top cover plate 36 which is snap-fitted on a top housing member 37, which in turn is secured to a bottom housing member 38 by a plurality of fasteners 39. Aligned posts 40 extending between a base 41 and bottom housing member 38 provides an open sound space 42 therebetween as shown in FIG. 6.

A battery 44 is mounted in the interior of housing 35 and provides the source of power to a logic control circuit indicated generally at 46, and shown diagrammatically in FIG. 7, which circuit is formed on a printed circuit board 48 mounted within housing 35. Logic control circuit 46 includes a main controller 49 and a wireless communication circuit 50 which preferably is an IR system to match that of programming station 3 as discussed above. Logic circuit 46 furthermore includes an audible alarm 51 which preferably is a piezoelectric alarm mounted within housing 35 and communicating directly with sound space 42 as shown in FIG. 6. Circuit 46 further includes a SDC memory 53, an EAS tag detector circuit 54, and one or more sense loops 13. A plunger switch 57 preferably is mounted within bottom housing member 38 and includes a plunger 58 which engages a support surface 59 on which alarm module 7 is mounted, preferably by one or more attachment screws (not shown). Plunger switch 57 will actuate alarm 51 if the alarm module is illegally removed from the supporting surface. An LED 61 is connected to logic control circuit 46 and extend through an opening formed in top housing member 37 and cover plate 36 to provide a visual indication of the status of alarm module 7.

One or more connection jacks 63 are formed in alarm module 7, for connecting an attachment cable 11 to alarm module 7 which cable contains a sense loop 13. Sense loops 13 preferably are electrical conductors, fiber optic conductors or the like, which as shown in FIG. 1 extends between alarm module 7 and an item of merchandise 9 to be protected thereby. Each sense loop 13 is operationally connected to controller 49 so that should the integrity of the sense loop or cable 11 be compromised, such as by cutting of the cable, pulling it loose from module 7 or from merchandise 9, it will sound audible alarm 51, as well as provide a certain flashing pattern to LED 61. If desired, cable 11 could be connected to an automatic recoiler located within module 7 without affecting the concept of the invention. The main feature is that the sense loop, and in particular conductor 13 thereof, is optically or electrically connected to controller 49 and to an item of merchandise 9.

A key receiving port 65 is formed in top cover plate 36 and top housing member 37 of housing 35 adjacent a light pipe 67 to enhance the transmission of infrared signals when smart key 5 is placed in port 65 and aligned with the transmitter and receiver 69 mounted on circuit board 48 below port 65 as shown in FIG. 6. This facilitates the transmission of IR waves between key 5 as discussed further below, and the wireless communication components 69 of communication circuit 50. Further details and manner of operation of alarm module 7 is shown and described in the above-referenced pending patent application, and it is readily understood that other types of circuit arrangements than that shown therein and shown in FIG. 7 could be utilized to achieve the features of alarm module 7 without affecting the concept of the invention.

Figure 8:
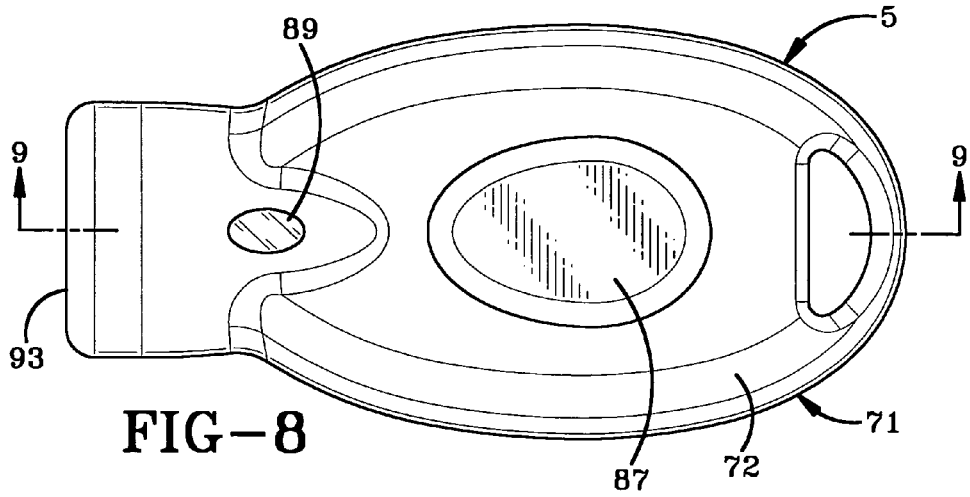
FIG. 8 is a plan view of the programmable smart key of the security system shown in FIG. 1.
Figure 9:
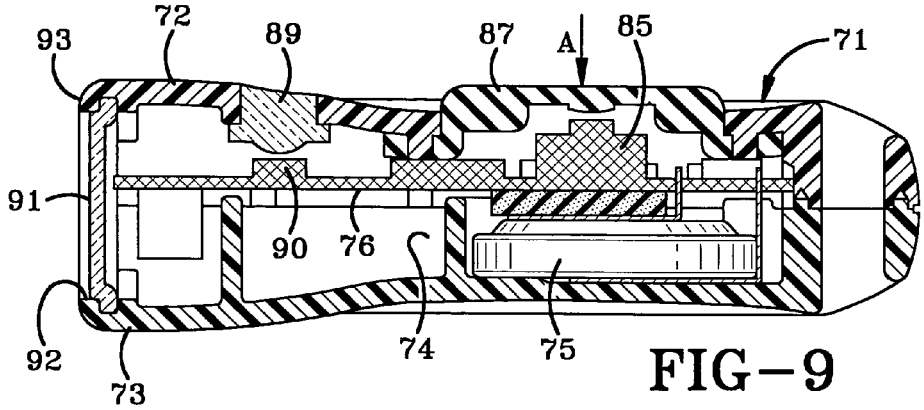
FIG. 9 is a cross-sectional view taken on line 9-9, FIG. 8.
Figure 10:
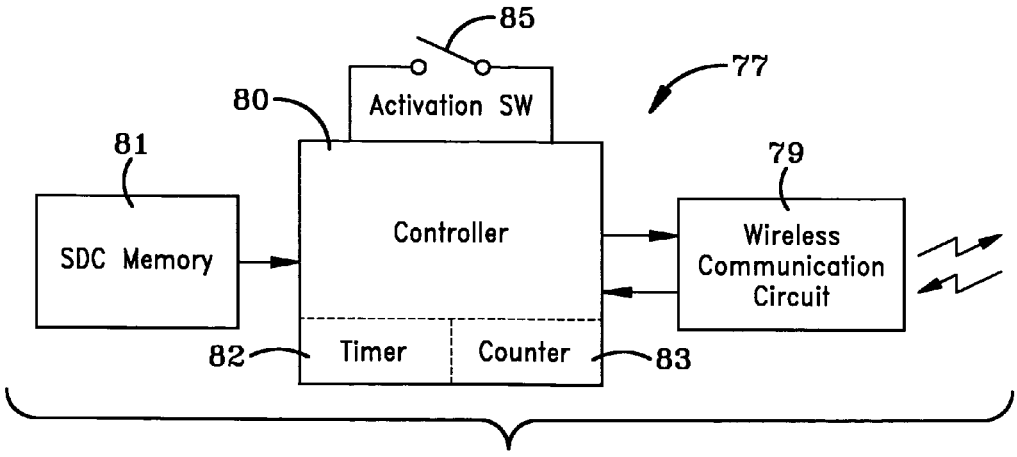
FIG. 10 is a block diagram of the logic control circuit of the programmable key shown in FIG. 8.

Smart key 5 is shown in detail in FIGS. 8-10. Key 5 includes a housing 71 formed by upper and lower plastic housing members 72 and 73 respectively, which are joined together to form a hollow interior 74 in which is mounted a battery 75 and a printed circuit board 76 containing a logic control circuit indicated generally at 77, and shown in block diagram form in FIG. 10. As shown in FIG. 10, logic control circuit 77 will include a wireless communication circuit 79 which preferably is IR operated so as to be compatible with the send and transmit components of programming station 3 and alarm module 7. A central controller 80, which preferably is a type of microprocessor, controls wireless communication circuit 79, a SDC memory 81, an internal timer 82 and an activation counter 83. Logic control circuit 77 is energized by an activation switch 85 which is mounted on circuit board 76 and located beneath a flexible member 87 mounted in upper housing member 72, so that when depressed as shown by Arrow A, FIG. 9, it will actuate the controller and logic control circuit 77.

A light pipe 89 preferably is mounted in upper housing member 72 in alignment with an LED 90 mounted on circuit board 76. LED 90 provides a visual indication of the status and activation of key 5 as discussed further below. A lens 91 is mounted in an opening 92 of housing end 93, which preferably is a visible light filter to enhance the transmission and reception of infrared waves when the key interfaces with programming station 3 and alarm module 7. Again, details of the circuitry and components of logic control circuit 77 are shown in the above-referenced patent application showing one example of a preferred circuit arrangement. However, it is readily understood that other circuit configurations can be utilized to achieve the results and features of key 5 than that shown and discussed above and in said pending patent application without affecting the concept of the invention.

FIG. 1 best illustrates the preferred system and method of the present invention. Programming station 3 is actuated by use of security key 33 which is placed in a circular key opening 95 which energizes the station. Smart key 5 is placed in key receiving port 29 and key switch 85 is actuated by depressing downwardly on flexible member 87. This causes logic control circuit 18 of programming station 3 to randomly generate a unique SDC which is transmitted via wireless communication circuit 20 to wireless communication circuit 79 of key 5 which stores the generated SDC in SDC memory 81 of the key. One or more of the LEDs 24 of programming station 3 and LED 90 of key 5 will illuminate or flash to indicate that station 3 is activated and operating satisfactorily and that the SDC has been transmitted to key 5.

In accordance with one of the features of the invention, the SDC which is initially generated by programming station 3 is randomly generated and is unique to station 3 and always remains with the station for subsequent use. Thus, when the first SDC is generated, this is the SDC that always stays with station 3 and is subsequently programmed into one or more keys 5. Key 5 now containing the SDC is taken to one or more alarm modules 7 and key end 93 is inserted into key receiving port 65 as shown in FIG. 5. Key switch 85 is then actuated programming SDC via the wireless communication systems 50 and 79 from key 5 into SDC memory 53 of logic control circuit 46 of alarm module 7. SDC memory 53 permanently stores this SDC in the programmed alarm module preferably for the life of the alarm module. Again, upon actuation of key switch 85, key LED 90 will flash as well as LED 61 of alarm module 7 indicating that a successful programming of the alarm module with the SDC has occurred.

In accordance with another of the features of the invention, the SDC when stored in memory 81 of key 5 will actuate a timer 82 for a predetermined time period, for example 96 hours. At the end of this time period, the SDC in memory 81 will automatically be erased or invalidated by control logic circuit 77 rendering the key inoperative if attempted to be used with alarm module 7. This prevents a key 5 from being stolen by a thief or dishonest employee and attempted to be reused after passage of this time period to disarm an alarm module 7 in the same store from which the key has been stolen. Furthermore, since the SDC in key 5 is unique to the particular programming station 3 of that retail establishment, even if key 5 is taken to another store using the same type of alarm module 7 when still within the valid time period of the SDC, the key will not function with the other store's alarm module since it will have been programmed with a different SDC. Thus, programmed key 5 prevents one of the main drawbacks of current security systems which uses various types of keys, since these prior security keys can always be used at one or more stores which use similar types of security devices, whether the key is a mechanical or magnetic actuated type of key. Thus, key 5 could only be used for a relatively short period of time by a thief or a dishonest employee and only in the particular store from which it was stolen. This preset time period could always be adjusted to 24 hours, 36 hours etc. without affecting the concept of the invention, although 96 hours has been found to be the preferred time period. Again, the transmission of the SDC between programming station 3 and key 5 and between key 5 and alarm module 7 is by the wireless communication transmission systems, preferably operating on IR or RF wavelengths.

Counter 83 of key control logic circuit 77 counts each time that key switch 85 is activated, whether when programmed with an SDC from programming station 3 or disarming an alarm module 7. After a predetermined number of activations, for example 55,000, counter 83 will cause logic control circuit 77 to inactivate the key rendering it inoperative for further use. This ensures that battery 75 always has a sufficient charge for the transmission of the SDC between the key and station 3 and modules 7.

In order to disarm alarm module 7, a validly programmed key 5 which is still within its active time period, will be placed into key receiving port 65 as shown in FIG. 5 and switch 85 is energized by depressing member 87. Wireless communication systems 50 and 79 will deactivate alarm 51 enabling cable 11 to be removed from object 9 or from the alarm module jack 63 for sale of item 9 to a customer or for attachment of a new or different type of merchandise to the alarm module. After the desired product manipulation has occurred, key 5 is then used to rearm the alarm module. Again, key LED 90 and alarm module LED 61 will flash in various patterns to indicate that the disarming has occurred and then subsequently that the rearming has occurred. Again, SDC memory 53 of alarm module 7 must read the same SDC code generated by key 5 in order to disarm module 7. If a different SDC is sensed by alarm module 7 than that stored in memory 53, module 7 will sound alarm 51 indicating that an incorrect key is being used. Likewise, if the SDC had been removed from the key by timer 82, the key will not operate or disarm the alarm module 7 and will provide a flashing signal that the disarming has not occurred and that an uncoded key is being used.

Furthermore, as shown in FIG. 6, the formation of sound space 42 and its direct communication with piezo alarm 51 will provide a greater dB level for the same size alarm than that occurs in prior alarm modules wherein the piezo alarm is mounted entirely within the alarm module housing. Alarm module 7, and in particular logic control circuit 46, contains an end of life (EOL) 97 or lifetime timer which is actuated when alarm module 7 is first energized. This timer has been preset at the factory for a specific time period, for example 3 or five years, depending upon the particular size of battery 44 contained therein. At the end of this lifetime period, control logic circuit 46 will deactivate alarm module 7 preventing its subsequent arming with an SDC. This ensures that the battery has sufficient power throughout the useful life of the alarm module. Furthermore, a counter 98 is provided in the alarm module which records the length of time that alarm 51 is operated since the alarm results in additional drain to the battery charge. This alarm time is then subtracted from the EOL period by a certain formulation. Again, this ensures that battery 44 has sufficient power to satisfactorily operate alarm module 7 even though the audible alarm has been used a number of times during its life.

An near end-of-life (NEOL) feature is also provided in control logic circuit 46 which will provide a visual signal such as particular flashing pattern of LED 61 and a different non-alarming chirping sound from alarm 51, when the end-of-life time out is approaching, for example five days before the end-of-life timer completely inactivates the alarm module circuitry.

Figure 11:
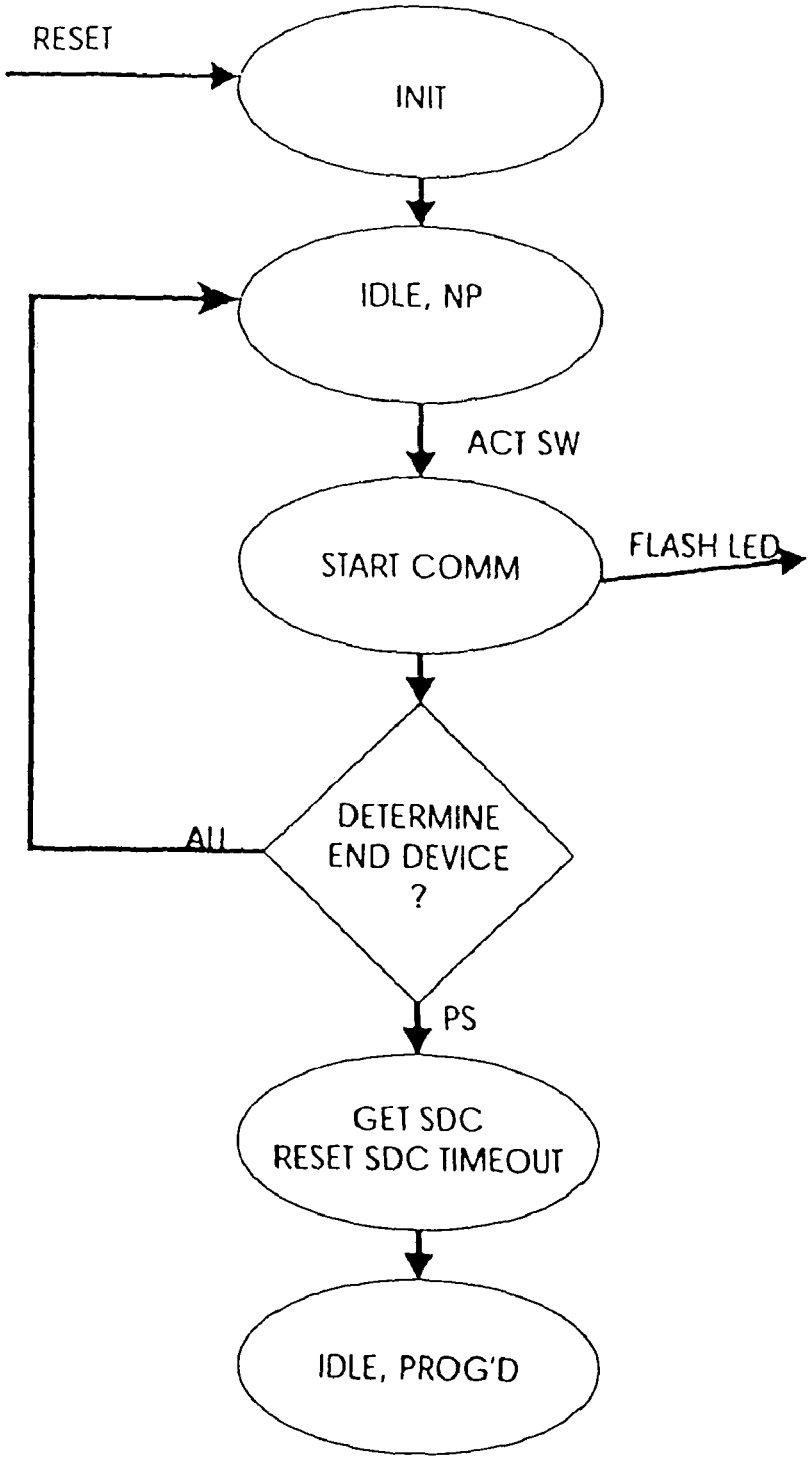
FIGS. 11, 11A and 11B is a flow chart of the control circuitry of the programmable key shown in FIG. 8.
Figure 11A:
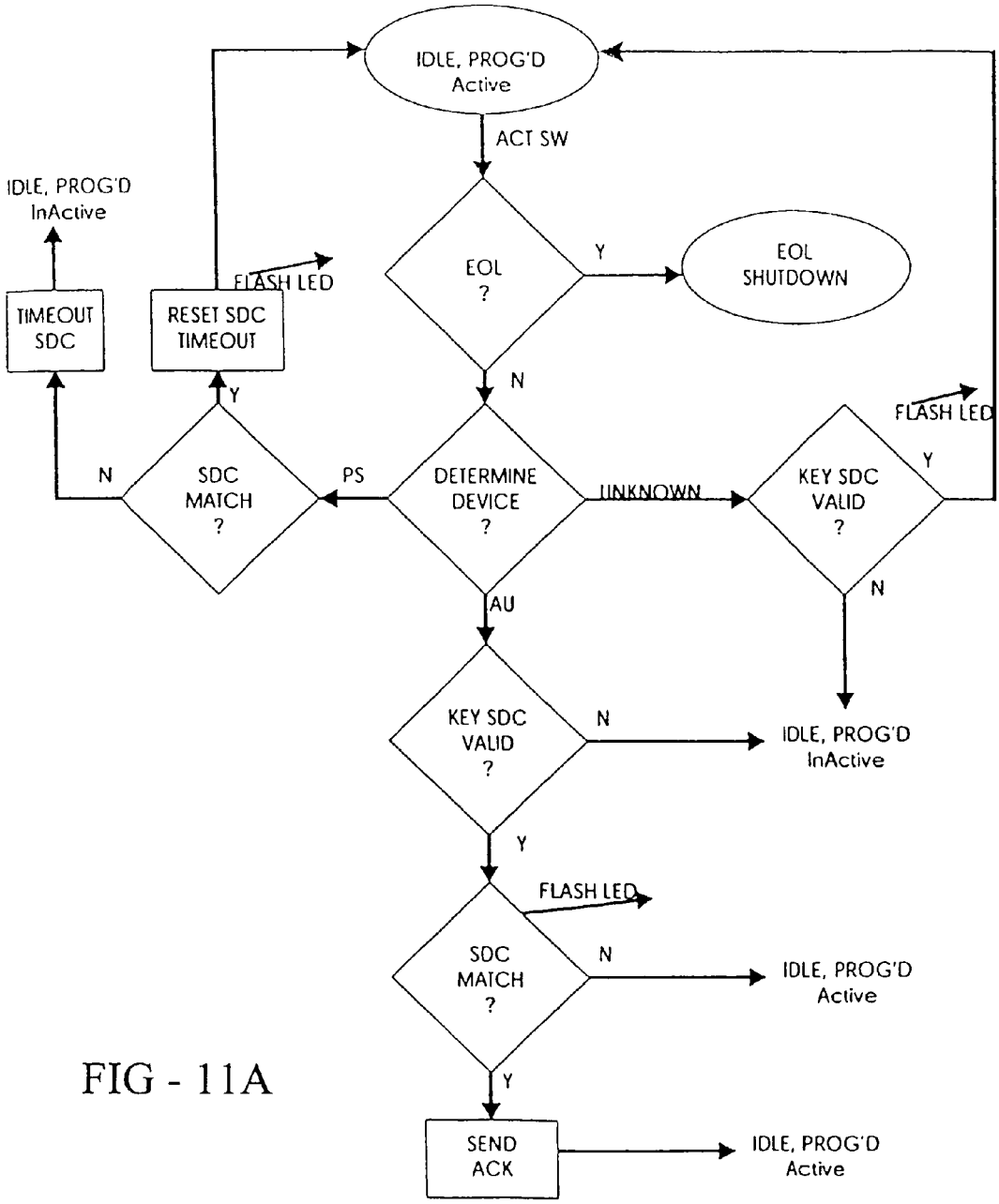
Figure 11B:
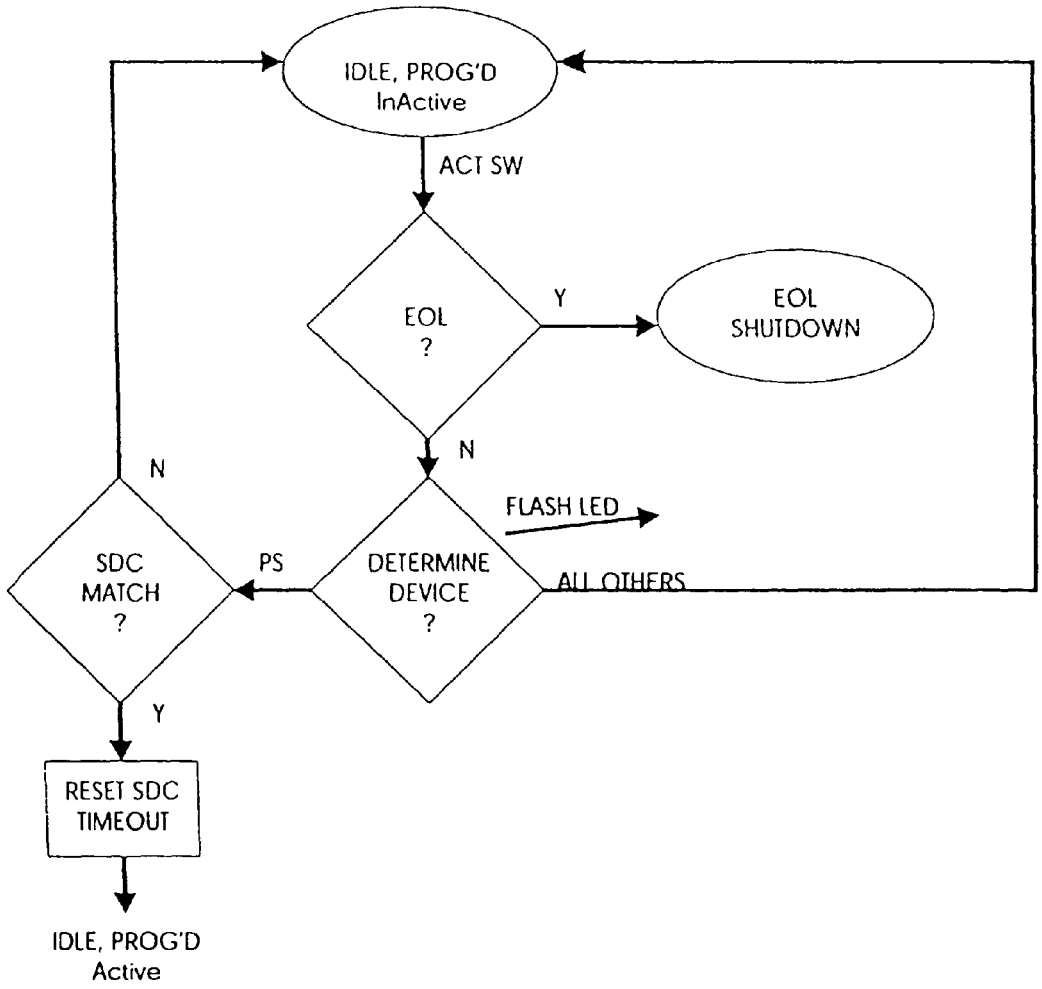
Figure 12:
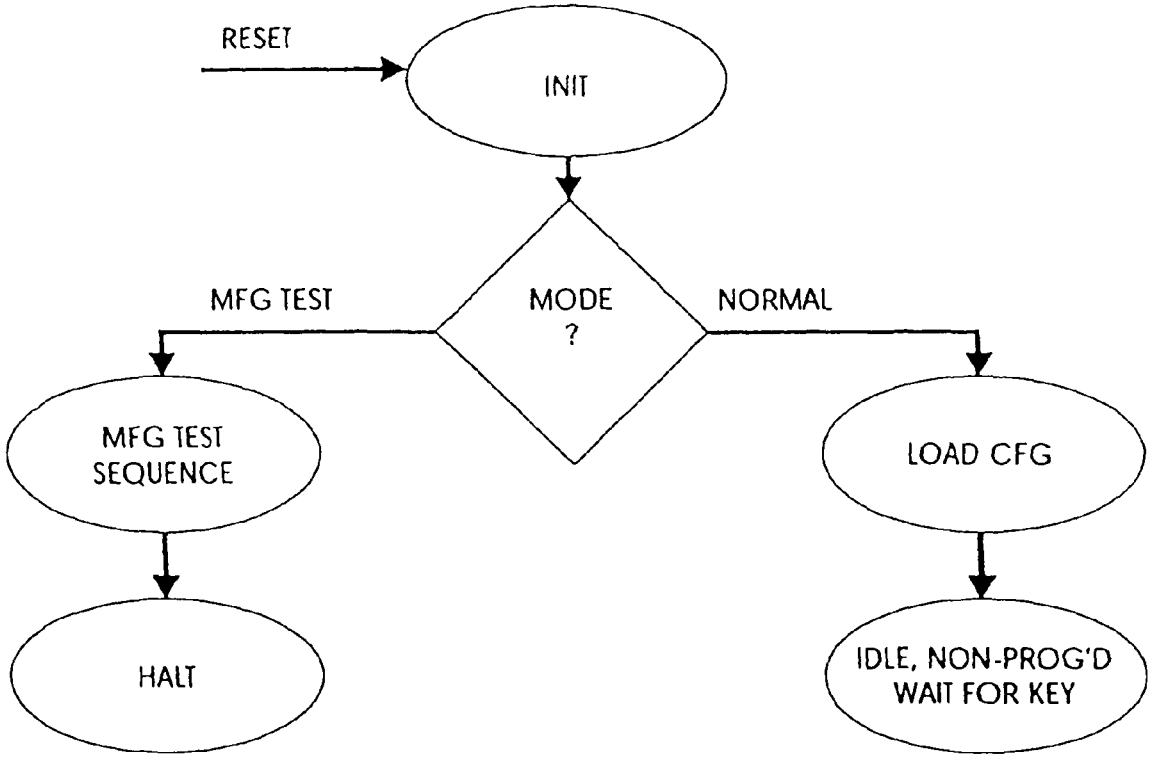
FIGS. 12, 12A and 12B is a flow chart of the control circuitry of the programming station shown in FIG. 2.
Figure 12A:
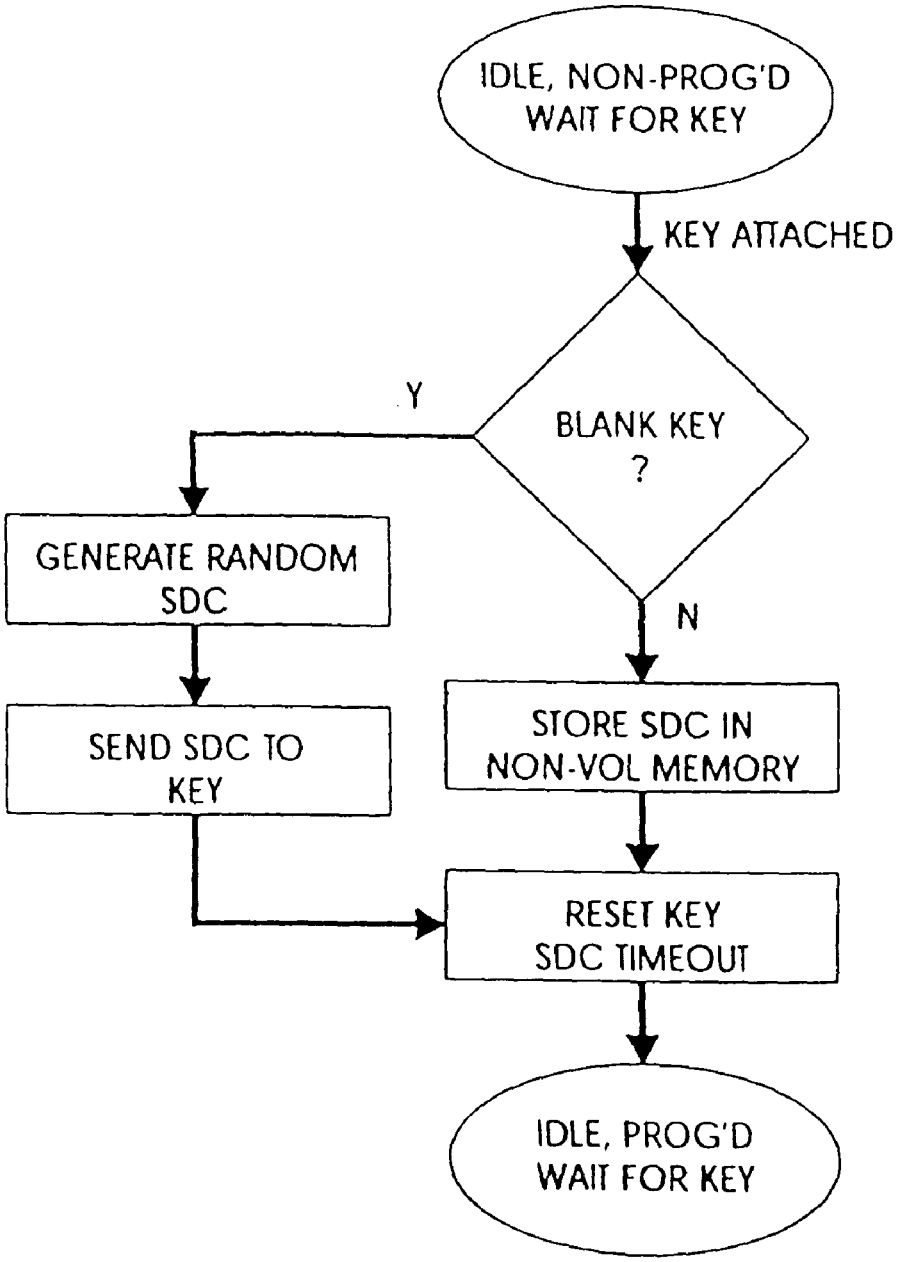
Figure 12B:
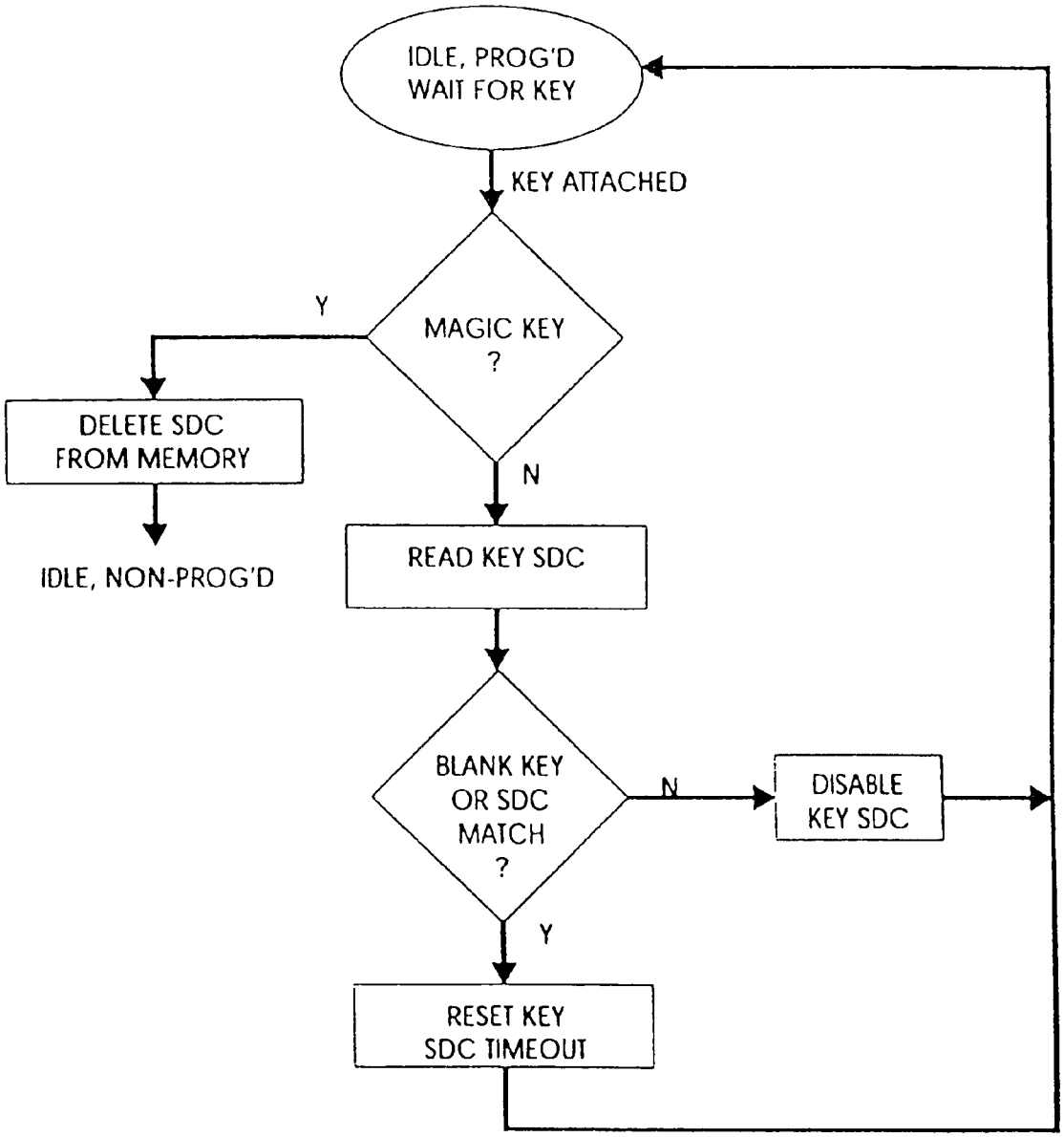
Figure 13:
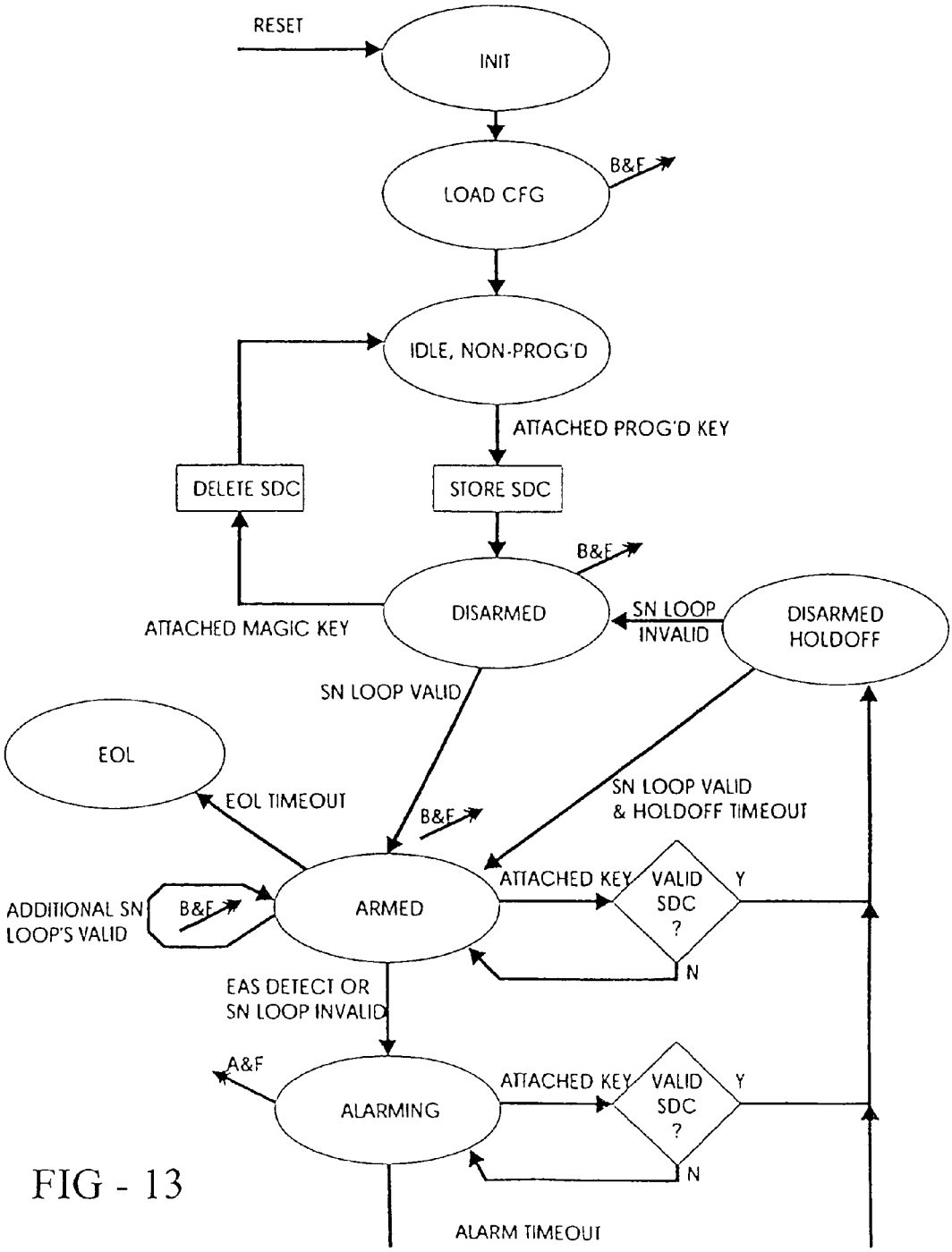
FIG. 13 is the flow chart of the control logic circuit for the security device shown in FIG. 5.

Further details of the operation of logic control circuitry 77 of programmable key 5 is shown in FIGS. 11-11B. FIGS. 12-12B shows additional details of the manner and method of operation of the logic control circuitry 18 of programming station 3, with FIG. 13 showing the manner of operation of the logic control circuitry 46 of alarm module 7. The sequence of events and actions taken by these various components and shown in the flow chart of FIGS. 11-13 is readily understood and followed by one skilled in the art.

Figure 14:
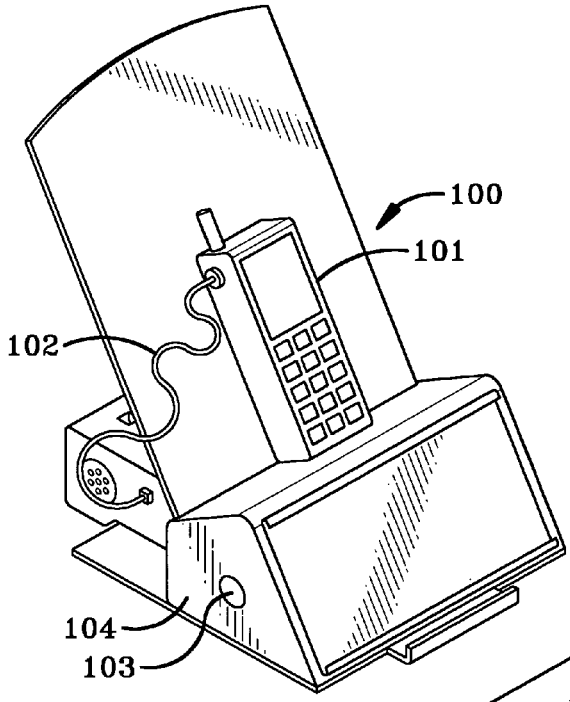
FIGS. 14, 15, 16 and 17 are diagrammatic views of other types of security devices which can be used with the security system of the present invention.
Figure 15:
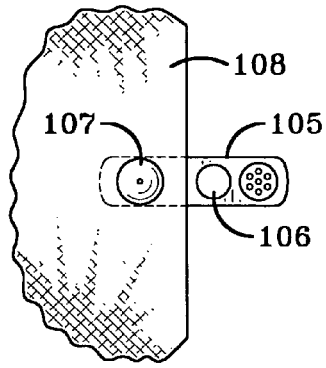
Figure 17:
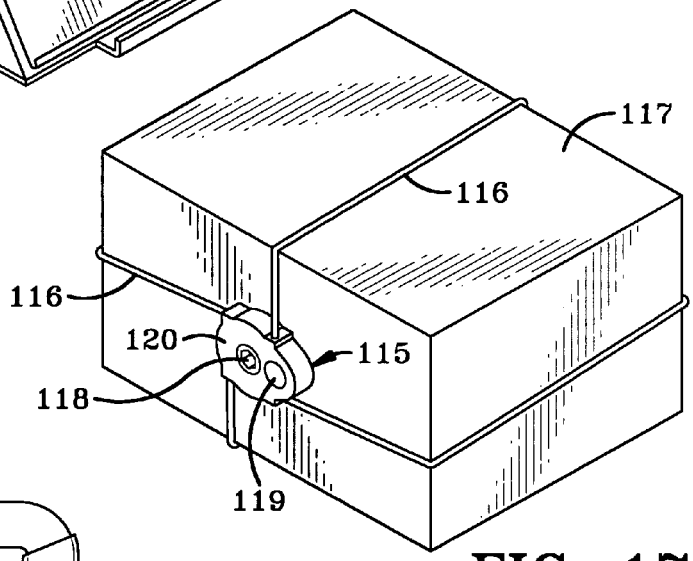
Figure 16:
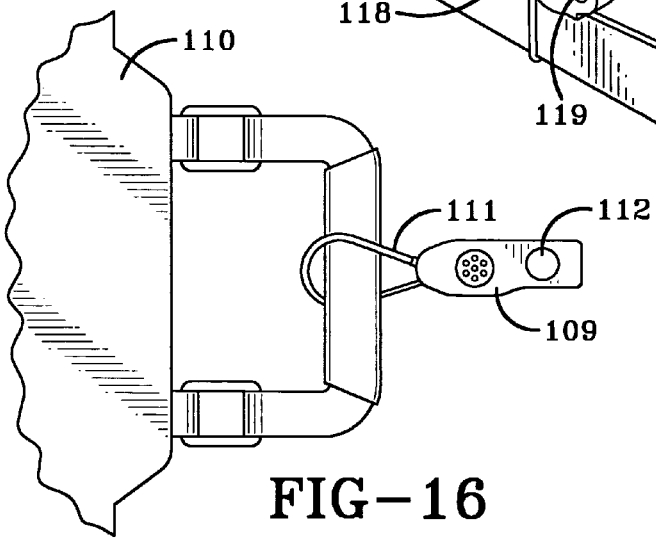

FIGS. 14-17 show examples of four other types of security devices which could be used in the security system and method of the present invention. FIG. 14 shows a product display security device indicated at 100 for displaying and protecting an item of merchandise 101 attached to a cable 102 which would contain a sense loop. A smart key receiving port 103 is formed in the security device housing 104, which when a key 5 is inserted therein would initially program and then subsequently disarm security device 100. FIG. 15 shows a type of garment tag security device 105 which is formed with a smart key receiving port 106 which is used to deactivate the security tag to enable a pin alarm 107 to be removed from a garment 108. FIG. 16 shows another type of cable alarm security device 109 which is connected about an item of merchandise 110 by a cable 111. Cable 111 contains a sense loop and will be formed with a smart key receiving port 112 therein in order to deactivate security device 109 enabling it to be removed from protected item 110. Still another type of security device indicated generally at 115, is shown in FIG. 17 which includes a plurality of cables 116 which extend about an item 117 to be protected thereby. It is readily understood that cables 116 preferably contain sense loops and are tightened about package 117 by a ratchet mechanism 118. A smart key receiving port 119 is provided, along with a logic control circuit etc. within a housing 120 containing the ratchet mechanism. FIGS. 14-17 merely show other examples of how the security system of the present invention and its method of operation can be utilized and that it need not be limited to the particular alarm module 7 shown and described above.

In summary, the improved security system of the present invention provides a system which can be used in numerous retail establishments, which utilizes a smart key as the main component, which even if stolen, cannot be used even in the store of its origin after a predetermined time period to disarm an alarm module, and can never be used in another store to disarm a security device since it is programmed with a SDC unique to that particular store, and that the SDC is initially randomly generated by a programming station used only by that store. The smart key contains the internal timer which will deactivate a validly stored SDC after a predetermined time period thereby rendering the key completely useless even in the store of its origin after this time period. The key merely has to be taken back to the programming station which can be maintained in a secure location enabling an authorized clerk to reprogram the key with the same SDC for subsequent use with the various alarm modules in the store, all of which will have been programmed from one of the smart keys with the unique SDC for that store. Also, programming station 3, smart key 5 and alarm module 7 each have various types of visual indicators and/or alarms which advise a store clerk of the status of the these components, and which will alert the clerk if an item of merchandise and/or alarm module is being tampered. Also, programming station 3 will deactivate a stored SDC in a key if it is the wrong SDC when attempting to reprogram the key at programming station 3. Also alarm module 7 will sound an alarm if a key containing a wrong SDC is attempted to be used on an alarm module. In addition to these features, each of the individual components have various timing circuits, control circuits and visual indicating circuits all of which are part of the internal logic control circuits contained in the components, which features are described in further detail in the above-referenced pending patent applications covering each of these components.

Another feature which may be incorporated into the present invention is the use of a "master" key and "employee" keys in order to provide an additional layer of security to the security system of a particular retail store. In this dual key system, the random number generator contained in the logic control circuit of the programming station will only generate the SDC when the master key is presented to the station and a limited access switch is activated. This master key then can be used to program the SDC into the various alarming modules, as well as the employee keys which are subsequently programmed with the SDC by the programming station once the SDC is generated by using the master key.

The use of the master key enables the store manager to change the SDC of the programming station which then is subsequently used by the employee keys and the alarm modules throughout the store, if for some reason the manager believes that the original SDC was compromised. Should a new SDC be generated by the master key and then reprogrammed into the employee keys, the control logic circuit of the alarm module, will be provided with a means of recognizing both the old and the new SDC of a key when in wireless communication therewith. This will enable the alarm module to accept the new SDC to disarm the alarm module without activating the audible alarm which would occur as discussed above, when the alarm module reads the use of a key having a wrong SDC programmed therein.

This dual key system would increase the complexity of the various logic control circuits in the smart keys, programming station and alarm modules, but would provide an additional layer of security should the location using the improved security system of the present invention desire such an increased level of security. However, the preferred embodiment described previously is believed to provide very adequate security protection for its merchandise system by the use of only a single key. However, the dual key system can be used without departing from the concept of the present invention.

Although the above description refers to the security code being a disarm code, it is understood that the code can activate and control other functions and features of the security device such as unlocking the device from the product, shutting off an alarm etc. without departing from the concept of the invention. Likewise, the various components of the logic circuit and resulting flow charts can easily be modified by one skilled in the art to achieve the same results. Also, the security code can be preset in the programming station at the factory or chosen by the customer, and if desired, be changed later by the customer, also without affecting the concept of the invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security system for protecting an item of merchandise comprising:

a) a programmable key;

b) a programming station for generating a security code in the key; and c) a security device for attachment to the item of merchandise, said security device being initially programmed with the security code from the key and subsequently being controlled by the key upon matching the security code of the key with the security code in the security device.

2. The security system defined in claim 1 wherein the programming station includes a wireless interface for generating the security code in the key.

3. The security system defined in claim 2 wherein the wireless interface is infrared (IR) or radio frequency (RF) communications.

4. The security system defined in claim 1 wherein the key includes an internal timer which automatically invalidates the security code in the key after a preset period of time.

5. The security system defined in claim 4 wherein the timer is a resettable timer upon receiving the security code from the programming station.

6. The security system defined in claim 1 wherein the key includes a counter which counts the number of activations of the key.

7. The security system defined in claim 6 wherein the counter permanently inactivates the key after counting a predetermined number of activations.

8. The security system defined in claim 7 wherein the counter causes an indicator to be activated advising that the key has a certain time period before being permanently inactivated.

9. The security system defined in claim 1 wherein the security device contains an audible alarm; and in which a sense loop connects the security device to the item of merchandise; and in which the alarm is activated upon the integrity of the sense loop being compromised.

10. A method of protecting an object including the steps of:

attaching an alarm module to an object;

programming a key with a security code;

programming the security code into the alarm module from the key;

controlling the alarm module by verifying the security code in the key with the security code in the alarm module by wireless communication between the key and alarm module; and invalidating the security code in the key after a period of time to prevent subsequent disarming of the alarm module by said key unless the security code is refreshed in the key within said period of time.

11. The method defined in claim 10 including the step of counting the number of activations of the key after programming the key with the security code and after the security code is refreshed in the key.

12. The method defined in claim 11 including the step of permanently inactivating the key after a certain number of activations.

13. The method defined in claim 12 including the step of providing a signal that the number of activations of the key is approaching the number which permanently inactivates the key.

14. The method defined in claim 10 including the step of sounding an alarm in the alarm module when the integrity of the alarm module is compromised.

15. The method defined in claim 10 including the steps of providing a programming station for generating the security code; and providing a wireless interface between the programming station and key for programming the key with the security code.

16. The method defined in claim 15 including the step of providing the wireless interface with infrared (IR) or radio frequency (RF) communication.

17. The method defined in claim 15 including the step of providing the alarm module with an internal timer which records the amount of time that an internal alarm is sounded.

18. The method defined in claim 10 including the step of sounding an alarm in the alarm module when an incorrect security code is communicated to the alarm module by a key other than the key programmed with the security code.

* * * * *